US006705751B1

(12) United States Patent
Liu

(10) Patent No.: US 6,705,751 B1
(45) Date of Patent: Mar. 16, 2004

(54) POST-TYPE ROPE LIGHT

(76) Inventor: Tzu-Chen Liu, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/270,375

(22) Filed: Oct. 15, 2002

(51) Int. Cl.[7] ..... F21S 8/08

(52) U.S. Cl. ..... 362/431; 362/153.1; 362/249; 362/251; 362/367; 362/373; 362/395

(58) Field of Search ..... 362/153, 153.1, 362/431, 414, 395, 367, 373, 294, 249, 251, 227

(56) References Cited

U.S. PATENT DOCUMENTS 5,647,660 A * 7/1997 Lee ..... 362/249
5,688,042 A * 11/1997 Madadi et al. ..... 362/240
6,126,303 A * 10/2000 Gross ..... 362/544
6,367,953 B1 * 4/2002 Lee ..... 362/252
6,474,840 B2 * 11/2002 Padermos ..... 362/249
6,634,767 B2 * 10/2003 Huang ..... 362/252

* cited by examiner

*Primary Examiner*—Laura K. Tso

(57) ABSTRACT

A post-type rope light has different structural designs of bottom bases and lamp posts to form a movable or a fixed post-type rope light. The present invention is assembled variably according to a user's need for conveniently moving and fixing thereby enhancing the practical value, increasing the esthetic thereof and beautifying the residential environment so as to achieve an effect of being practical and beautiful.

7 Claims, 7 Drawing Sheets

POST-TYPE ROPE LIGHT

BACKGROUND OF THE INVENTION

1) Field of the Invention

The present invention relates to a post-type rope light, more particularly to a rope light either in a movable type or in a fixed type to convenience a user in moving and fixing it thereby enhancing the practical value, increasing the esthetic thereof and beautifying the residential environment so as to achieve an effect of being practical and beautiful.

2) Description of the Prior Art

Accordingly, the style of a conventional rope light has been seldom changed and the function thereof has been limited to illumination with linear decoration; for example, the writings and patterns on a store billboard, the Christmas ornaments or the decorations for national independence days are all finished only in a planar, linear or arcuate style, but not designed to be in a post-type or have other kinds of decorations thereon. Therefore, the inventor of the present invention researched and developed a post-type rope light being more practical, having more extensive application scope and complying with the industrial utilization value.

SUMMARY OF THE INVENTION

Mainly, the present invention is divided into a movable and a fixed types; wherein the movable post-type rope light has a squeezed X-shaped lamp post inserted into a hollow post of a bottom base; then four diagonal angel areas of the X-shape are respectively filled with at least one rope light; two sides of the four side angels are folded inwardly to form corresponding slots to be inserted respectively by rubber plates made of diaphanous material thereby forming four side surfaces of the lamp post. Then a lamp cover made of diaphanous material and manufactured in any style are disposed at the top end of the lamp post; finally, a pedal type on/off switch connects with a rope light circuit in the lamp post. A fixed post-type rope light has a tail end made of diaphanous material on the lamp post thereof and disposed as a nut to fitly screw with a spiral post on the bottom base. A ground peg is disposed beneath the bottom base for inserting into the ground; the central area of the lamp post is hollow for filling in at least one rope light. The rest structural designs of a lamp cover and a switch are the same as that of a movable rope light.

The primary objective of the present invention is to utilize the structural designs of different bottom bases and lamp posts to form a movable or a fixed post-type rope light as well as to assemble and design variably according to a user's need so as to enhance the practicality of the rope light.

The secondary objective of the present invention is to squeeze the movable or fixed post-type rope light to have a post in a hollow rectangular shape, a hollow rectangular shape having four spaced apart partition walls or a hollow round shape.

The third objective of the present invention is to design the lamp cover of the movable or fixed post-type rope light to be molded unitarily or assembly by cover frames; furthermore, decorations are disposed on the peripheral rims on the cover frames and the rope light are disposed therein or affixed thereon.

To enable a further understanding of the objectives, features and the functions of the present invention, the brief description of the drawings below is followed by the detailed description of the preferred embodiment.

DETAILED DESCRIPTION OF THE PREFERRED EMBODIMENTS

Figure 1:
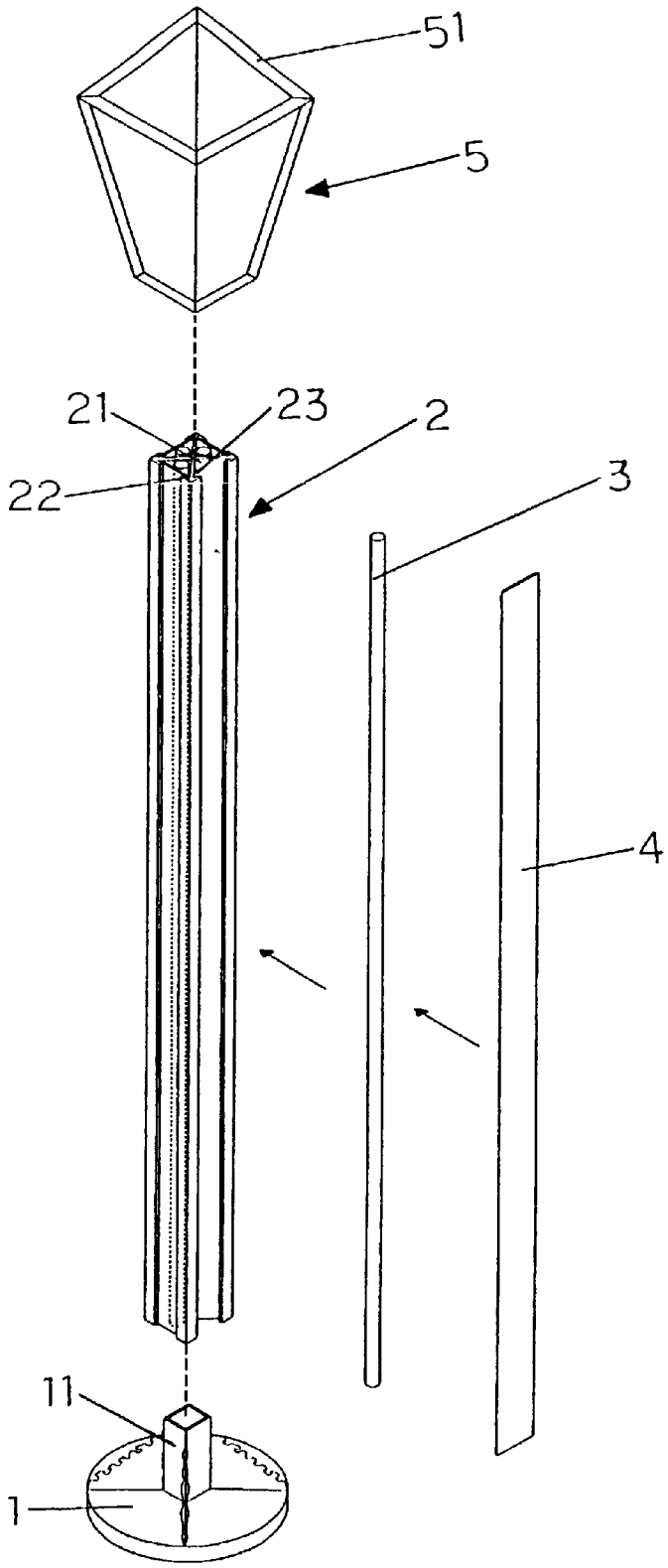
FIG. 1 is an exploded and pictorial drawing of a movable post-type rope light of the present invention.
Figure 2:
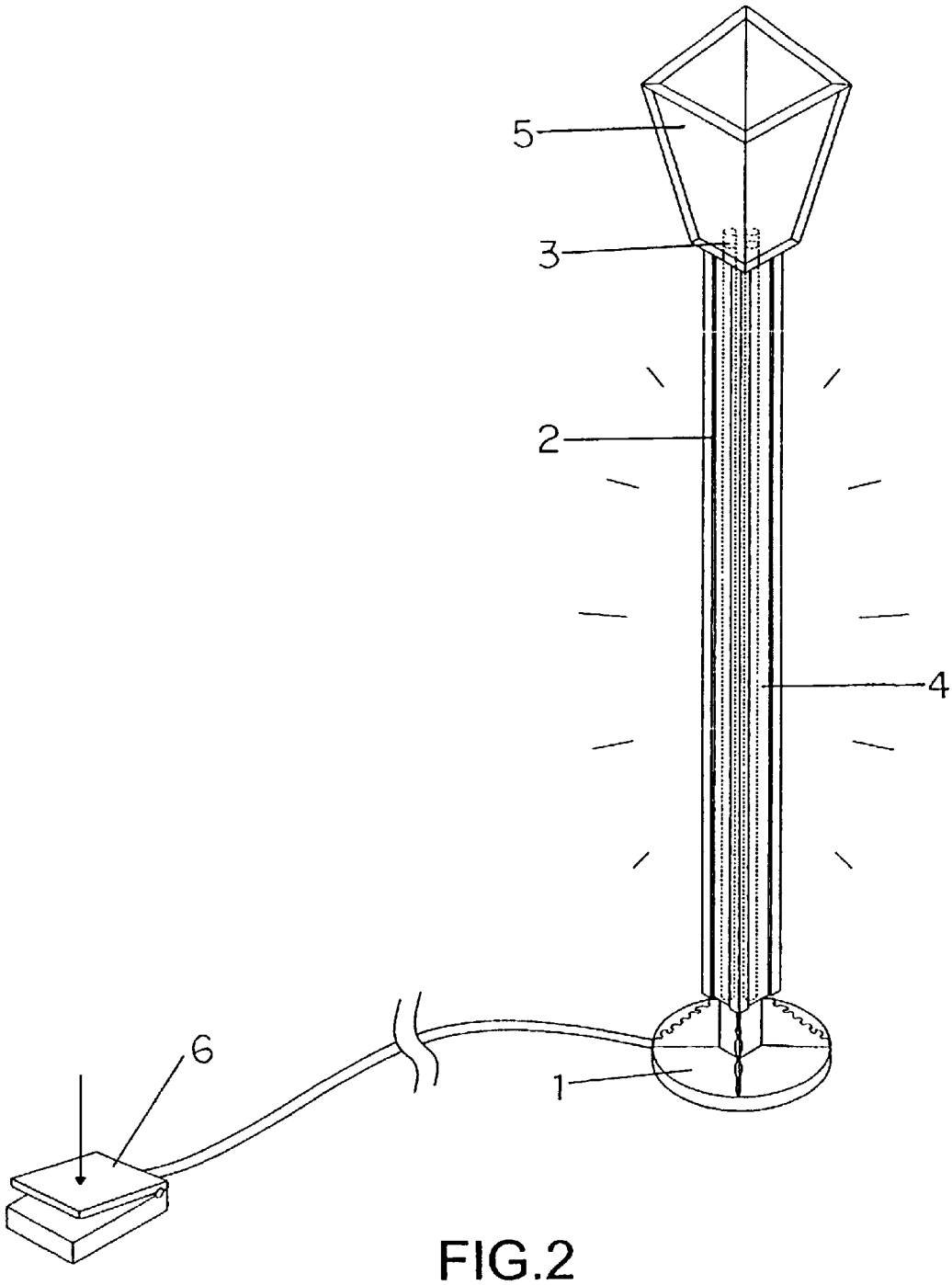
FIG. 2 is a pictorial drawing of assembling the movable post-type rope light of the present invention.

FIGS. 1 and 2 show the exploded and the assembly pictorial drawings of the present invention of a post-type rope light composing a bottom base (1) with the central area thereof extends to dispose a hollow post (11); a squeezed lamp post (2) in a X-shape with a tail end inserted into the hollow post (11) of the bottom base (1). Four diagonal angle areas (21) are respectively filled with at least one rope light (3); two sides of four side angles (22) are folded inwardly to form corresponding slots (23) provided respectively for the insertion of rubber plates (4) made of diaphanous material thereby forming four sides of the lamp post (2).

A lamp cover (5) in any shape, such as a rectangular, circular, fruit, animal or plant shape, etc., is made of diaphanous material and disposed at the top end of the lamp post (2). An on/off switch (6) is connected to the circuit of the rope light (3) inside the lamp post (2) and in a pedal type for facilitating the on/off control of the rope light (3).

According to the abovementioned, the lamp post (3) is squeezed into a hollow rectangular shape, a hollow rectangular shape having four spaced apart partition walls or a hollow round shape; the peripheral rim of the lamp post (2) are painted in any color, such as a golden, silver, copper, dark golden color, etc., for increasing the esthetic thereof. The lamp cover (5) is molded unitarily or assembled by cover frames (51) with decorations disposed on the peripheral rims thereof and with the rope light (3) directly disposed therein or affixed thereon.

According to the abovementioned, when assembling the present invention of a movable post-type lamp, first the squeezed lamp post (2) in an X-shape is inserted into the hollow post (11) on the bottom base (1); then at least one rope light (3) is respectively filled into the four diagonal areas (21) of the X-shape; then the diaphanous rubber plates (4) are respectively inserted into the corresponding slots (23) formed by folding the two sides of four side angles (22) inwardly; then the diaphanous lamp cover (5) is disposed at the top end of the lamp post (2); finally, a pedal type on/off switch (6) is connected to a rope light (3) circuit inside the lamp post (2) for facilitating a user to turn on or off the rope light (3).

Figure 3:
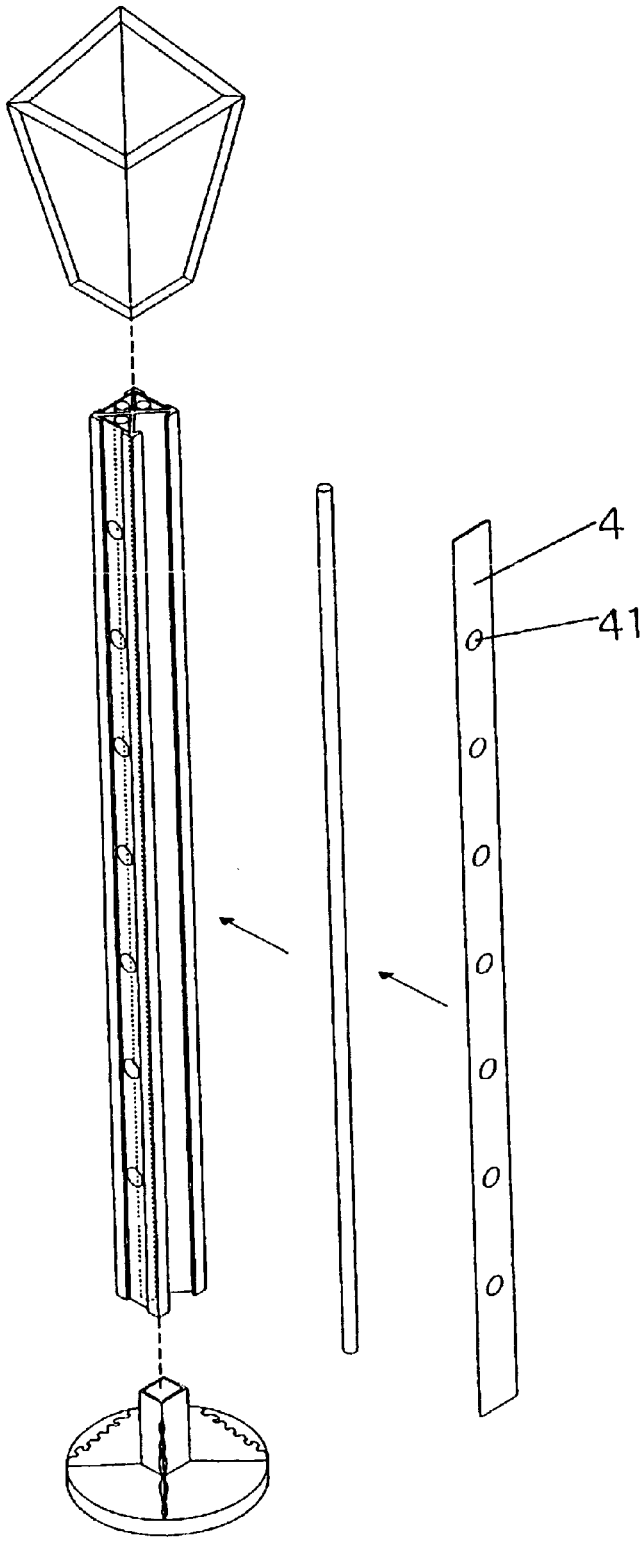
FIG. 3 is a drawing of another exemplary embodiment of a movable post-type rope light of the present invention.

FIG. 3 shows another exemplary embodiment of the present invention; a plurality of heat dissipation holes (41) are disposed on the surfaces of the rubber plates (4) made of diaphanous material for dissipating the teat of the rope light (3) inside the lamp post (2).

Figure 4:
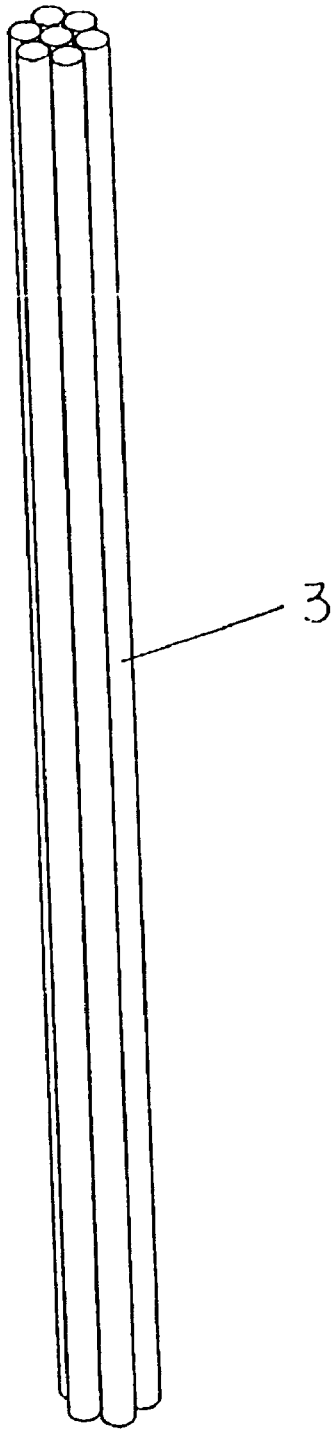
FIG. 4 is a drawing of yet another exemplary embodiment of a movable post-type rope light of the present invention.

FIG. 4 shows yet another exemplary embodiment of the present invention; as indicated, the present invention is assembled by said a plurality of rope lights (3) to directly insert into the hollow post (11) on the bottom base (1) for replacing the lamp post (2).

Figure 5:
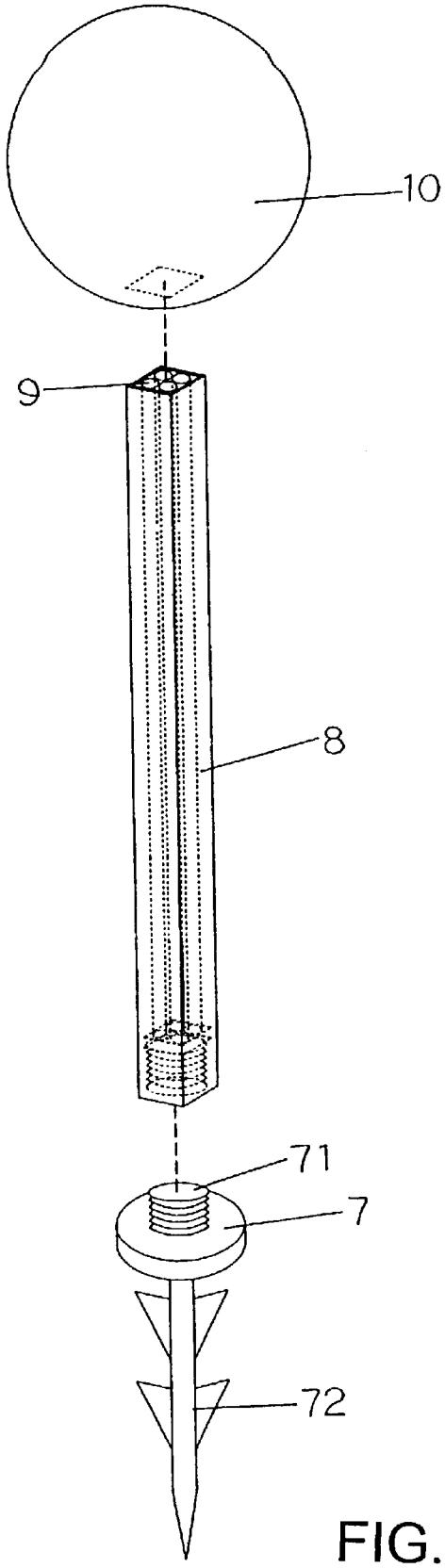
FIG. 5 is an exploded and pictorial drawing of a fixed post-type rope light of the present invention.
Figure 6:
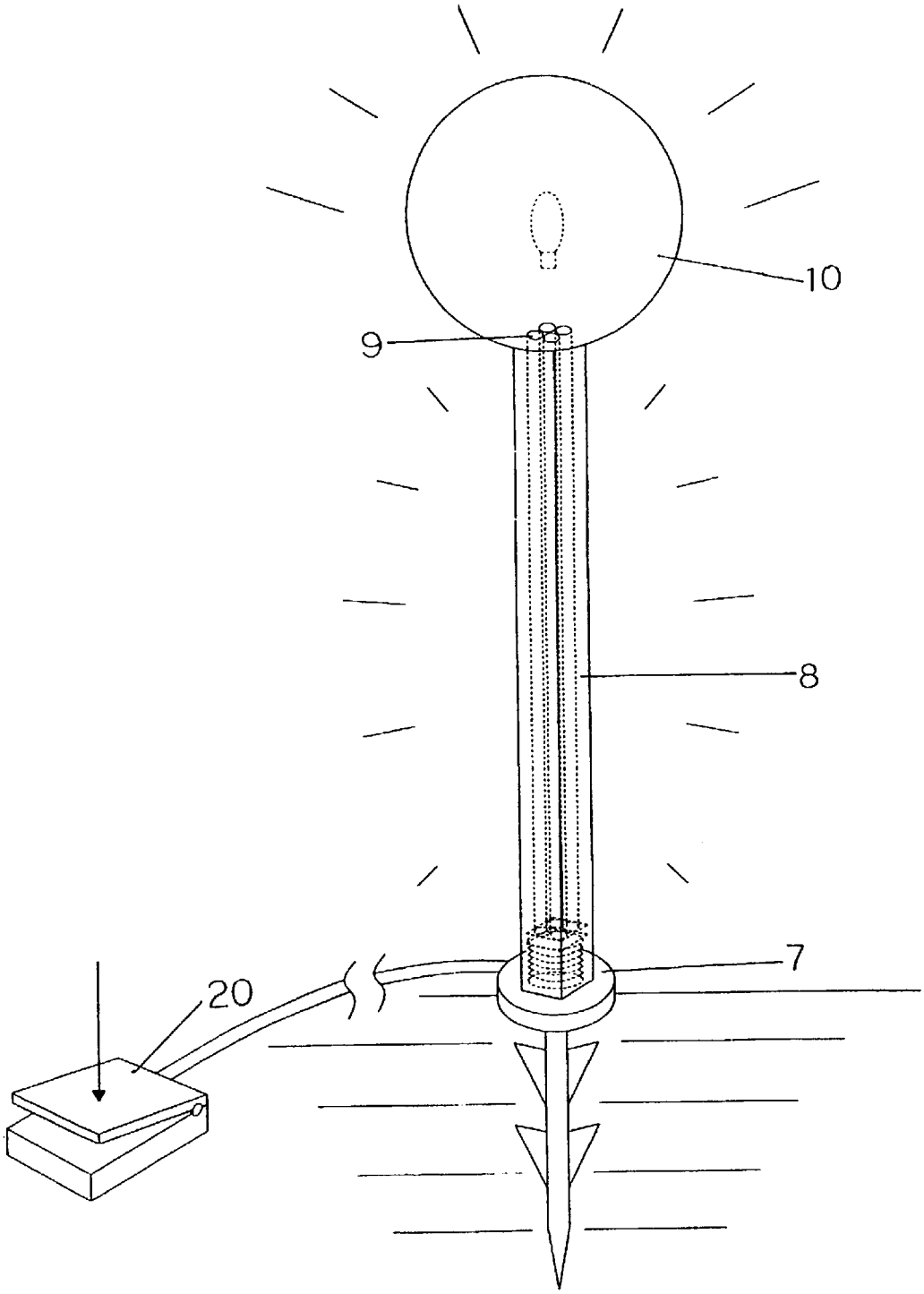
FIG. 6 is a pictorial drawing of assembling the fixed post-type rope light of the present invention.

FIGS. 5 and 6 show the exploded and the assembly pictorial drawings of the present invention of a fixed post-type rope light comprising a bottom base (7) with the central area thereof extends upwardly to dispose a spiral post (71) and downwardly to dispose a ground peg (72) for inserting into the ground. A lamp post (8) is made of diaphanous material with a tail end thereof disposed as a nut (81) to correspondingly and fixedly screw into the spiral post (71) on the bottom base (7); the central interior area of the lamp post (8) is hollow for filling in at least one rope light (9). A lamp cover (10) in any shape is made of diaphanous material and disposed at the top end of the lamp post (8). An on/off switch (20) is connected to a rope light (9) circuit inside the lamp post (8) and is in a pedal type for facilitating the on/off control of the rope light (9).

According to the abovementioned, the lamp post (8) is squeezed into a hollow rectangular shape, a hollow rectangular shape having four spaced apart partition walls or a hollow round shape; the peripheral rim of the lamp post (8) are painted in any color, such as a golden, silver, copper, dark golden color, etc., for increasing the esthetic thereof. The structural designs of the lamp cover (10) and the on/off switch (12) are the same as that of the movable post-type rope light.

According to the abovementioned, when assembling the present invention of the fixed post-type of rope light, first the ground peg (72) of the bottom base (7) is inserted into the ground, then the nut (81) at the tail end of the diaphanous lamp post (8) fitly screws into the spiral post (71) of the bottom base (7); then at least one rope light (9) is filled into the hollow area of the lamp post (8); then the diaphanous lamp cover (10) is disposed at the top end of the lamp post (8); finally, a pedal type on/off switch (20) is connected to a rope light (9) circuit inside the lamp post (8) for facilitating the user to turn on or off the rope light (9).

Figure 7:
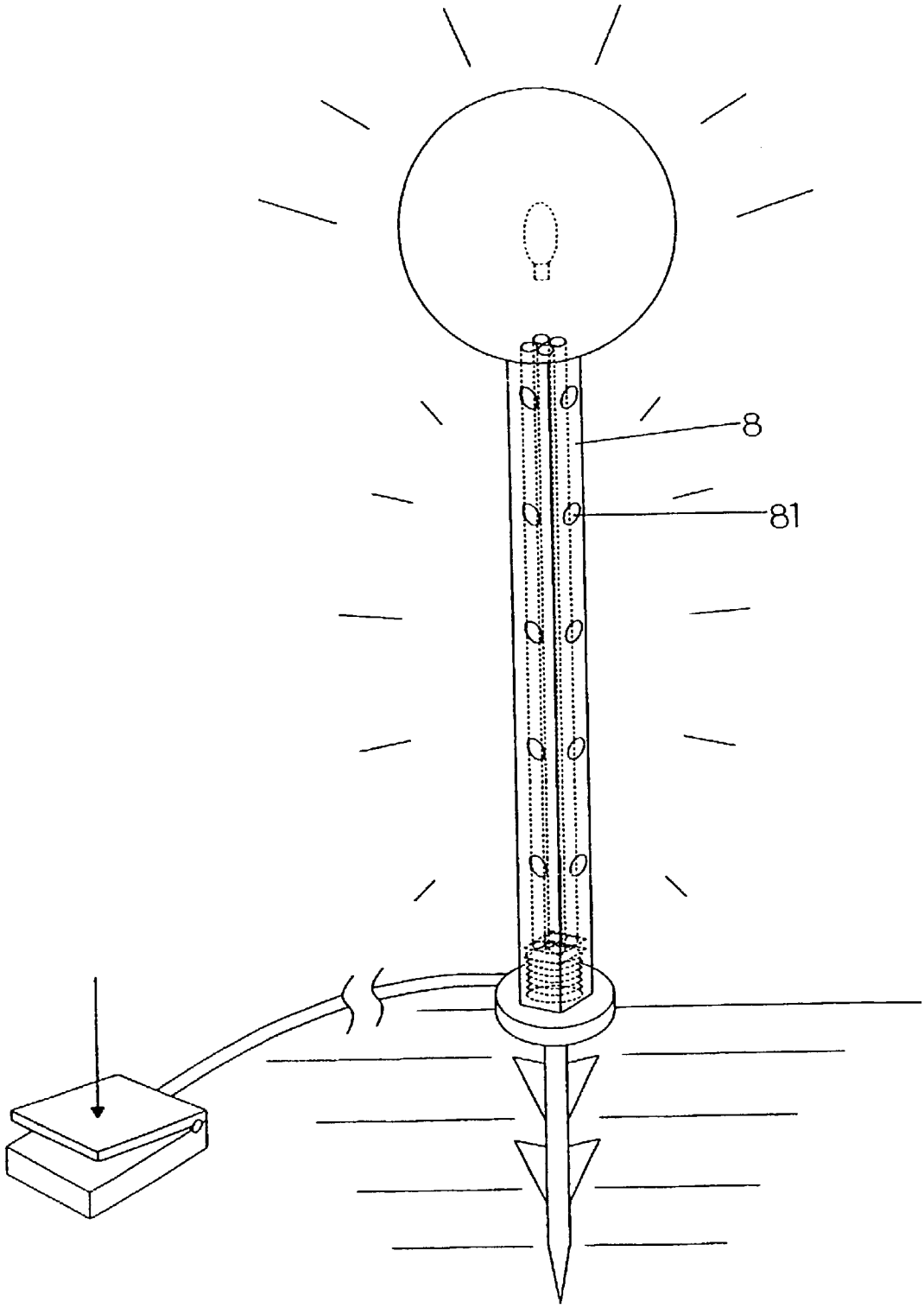
FIG. 7 is a drawing of another exemplary embodiment of a fixed post-type rope light of the present invention.

FIG. 7 shows another exemplary embodiment of the present invention; a plurality of heat dissipation holes (82) are disposed on the four peripheral surfaces of the lamp post (8) for dissipating the heat of the rope light (9) inside the lamp post (8).

In summation of the abovementioned, the present invention of the post-type rope light has different structural designs of bottom bases and lamp posts to form a movable or a fixed post-type rope light. The present invention is assembled variably according to the user's need. The innovation invention has not been disclosed previously. The peripheral rims of the lamp post are painted in various colors; decorations and rope lights are disposed on the peripheral rims of the cover frames of the lamp cover for increasing the stylish art and strengthen the visual esthetic.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A post-type rope light comprises:

a bottom base with the central area thereof extending to dispose a hollow post;

a squeezed lamp post in a X-shape with a tail end inserted into the hollow post of the bottom base; four diagonal angle areas are respectively filled with at least one rope light; two sides of four side angles are folded inwardly to form corresponding slots provided respectively for the insertion of rubber plates made of diaphanous material thereby forming four sides of the lamp post;

a lamp cover in any shape made of diaphanous material and disposed at the top end of the lamp post;

an on/off switch connected to a rope light circuit inside the lamp post and in a pedal type for facilitating the on/off control of the rope light;

the structural designs of the abovementioned members form a movable rope light for facilitating the user to move the present invention so as to enhance the practical value of the rope light, increase the esthetic thereof and beautifying the residential environment.

2. The post-type rope light according to claim 1, wherein the lamp post is squeezed into a hollow rectangular shape, a hollow rectangular shape having four spaced apart partition walls or a hollow round shape.

3. The post-type rope light according to claim 1, wherein a plurality of heat dissipation holes are disposed on the four peripheral surfaces of the lamp post for dissipating the heat of the rope light inside the lamp post.

4. The post-type rope light according to claim 1, wherein the lamp cover is molded unitarily or assembly by cover frames; furthermore, decorations are disposed on the peripheral rims on the cover frames and the rope lights are disposed therein or affixed thereon.

5. A post-type rope light comprises:

a bottom base with the central area thereof extending upwardly to dispose a spiral post and downwardly to dispose a ground peg for inserting into the ground;

a lamp post made of diaphanous material with a tail end thereof disposed as a nut to correspondingly and fixedly screw into the spiral post on the bottom base; the central interior area of the lamp post is hollow for filling in at least one rope light;

a lamp cover in any shape made of diaphanous material and disposed at the top end of the lamp post;

an on/off switch connected to a rope light circuit inside the lamp post and in a pedal type for facilitating the on/off control of the rope light;

the structural designs of the abovementioned members form a fixed rope light for facilitating the user to fix the present invention so as to enhance the practical value of the rope light, increase the esthetic and beautifying the residential environment.

6. The post-type rope light according to claim 4, wherein the lamp post is squeezed into a hollow rectangular shape, a hollow rectangular shape having four spaced apart partition walls or a hollow round shape.

7. The post-type rope light according to claim 5, wherein a plurality of heat dissipation holes are disposed on the four peripheral surfaces of the lamp post for dissipating the heat of the rope light inside the lamp post.

* * * * *